US006550540B2

(12) United States Patent
Trent

(10) Patent No.: US 6,550,540 B2
(45) Date of Patent: Apr. 22, 2003

(54) MECHANICAL ANCHOR SETTING SYSTEM

(76) Inventor: Darren W. S. Trent, 4819, 22 Avenue N.W., Calgary, Alberta (CA), T3B 0Y4

( * ) Notice: Subject to any disclaimer, the term of this patent is extended or adjusted under 35 U.S.C. 154(b) by 0 days.

(21) Appl. No.: 09/854,908

(22) Filed: May 14, 2001

(65) Prior Publication Data

US 2002/0166670 A1 Nov. 14, 2002

(51) Int. Cl.[7] ..... E21B 23/00
(52) U.S. Cl. ..... 166/382; 166/134
(58) Field of Search ..... 166/120, 118, 166/119, 128, 134, 136, 138, 180, 382, 381

(56) References Cited

U.S. PATENT DOCUMENTS

| | | | | | |
|---|---|---|---|---|---|
| 4,369,840 | A | * | 1/1983 | Szarka et al. | 166/214 |
| 4,441,553 | A | * | 4/1984 | Setterberg, Jr. et al. | 166/138 |
| 4,482,013 | A | * | 11/1984 | Fulkerson | 166/118 |
| 5,333,685 | A | * | 8/1994 | Gilbert | 166/123 |
| 5,348,090 | A | | 9/1994 | Leismer | |
| 6,073,693 | A | | 6/2000 | Aldridge | |
| 6,131,663 | A | * | 10/2000 | Henley et al. | 166/373 |
| 6,152,233 | A | | 11/2000 | Jani et al. | |
| 6,155,346 | A | | 12/2000 | Aldridge | |
| 6,199,632 | B1 | | 3/2001 | Shy | |
| 6,241,017 | B1 | * | 6/2001 | Doane et al. | 166/134 |
| 6,378,606 | B1 | * | 4/2002 | Swor et al. | 166/217 |

FOREIGN PATENT DOCUMENTS

| | | |
|---|---|---|
| CA | 1273866 | 9/1990 |
| CA | 2077990 | 3/1994 |
| CA | 2122394 | 11/1994 |
| CA | 2185077 | 3/1998 |
| CA | 2241360 | 11/1998 |
| CA | 2223870 | 7/1999 |
| CA | 2227354 | 7/1999 |

* cited by examiner

*Primary Examiner*—Frank S. Tsay
(74) *Attorney, Agent, or Firm*—Reed Smith LLP

(57) ABSTRACT

A downhole mechanical anchor setting system which can be positively set in variable positions. More specifically, a mechanical anchor setting system for anchoring a downhole assembly in a well bore. The system includes a mandrel which is longitudinally moveable within a sleeve and a slip system operatively connected to the sleeve and the mandrel for gripping the casing or formation of the well bore when in an engaged position. The system also includes a setting control system operatively connected to the sleeve and the mandrel for selectively setting the slip system in any one of the engaged position, a disengaged position allowing downhole movement of the system and an intermediate position allowing uphole movement of the system without engaging the slip system.

9 Claims, 4 Drawing Sheets

MECHANICAL ANCHOR SETTING SYSTEM

FIELD OF THE INVENTION

The present invention relates generally to a downhole mechanical anchor setting system which can be positively set in variable positions.

BACKGROUND OF THE INVENTION AND PRIOR ART

A perforating gun is commonly used in downhole systems for perforating hydrocarbon formations for producing wells. As is well known, selective perforation allows either oil or gas to flow to the present production zone depending on the type of well.

The prior art teaches various types of perforating gun systems and methods of operation, each having different functionality. For example, past systems disclose a perforating gun string that allows several perforating discharges to be set without having to reload. Such a system allows the perforating gun to create perforations at different depths in the same well bore without uphole retrieval after each discharge.

One problem with the use of a perforating gun is that it typically recoils when it is discharged. The recoil can cause the perforating gun assembly to surge upward within the well which can cause significant damage to the perforating gun and wireline or coiled tubing equipment. Further, if the perforating gun operates effectively then oil and gas may also surge uphole which can similarly cause equipment damage.

Partial solutions to the perforating gun's recoil problem have been provided in different forms of mechanical anchors. For example, these mechanical anchors may arrest the movement of the perforating gun when it is discharged and/or use slips or grips which frictionally engage the casing or formation at an increasing rate as increasing upward pressure is applied.

An example of a expanded slip well anchor is taught in U.S. Pat. No. 5,348,090. This anchor teaches a body and a mandrel that is longitudinally movable through the body. Attached to the mandrel are two sets of slips which are designed with opposing wedged surfaces to engage each other. When the slips are engaged they expand outwards and frictionally engage the casing or formation. This patent teaches setting the position of the anchor by using shearing pins. However, this patent does not teach an apparatus or process to reset the anchor's position.

Another anchor is taught in U.S. Pat. No. 6,152,233 issued on Nov. 28, 2000. This patent teaches an anchoring system which can be repeatedly positioned at different locations within the well without removing the system from the well. However, this patent does not teach an apparatus having more than two internal setting positions, including a setting where the anchoring system is set (engaged), a setting where the anchoring system is not set allowing downhole movement (disengaged) and a setting where the system is not set allowing uphole movement (intermediate).

More specifically, the prior art does not teach selective internal setting positions. This means that in certain past devices, tension must be applied to hold the slips in an engaged (or set) position and a sinker bar or reliance on gravity is used to release the slips from their engaged position. Further, without an intermediate setting position, in the past, the entire tool assembly cannot be positioned uphole without applying the appropriate amount of upward tension of the wireline (without engaging the slips) to move the mandrel at the same time as the sleeve. Accordingly, there has been a need for a mechanical anchor setting system having multiple and selective setting positions allowing uphole and downhole movement and positive setting and release of mechanical anchors.

SUMMARY OF THE INVENTION

The present invention teaches an apparatus and process for positively setting the mechanical anchor in at least three positions. At a minimum, the mechanical anchor setting control system provides a set position where the slips are engaged, another position where the slips are not engaged and an intermediate position between the engaged and disengaged positions which allows easy movement of the mechanical anchor assembly uphole.

The mechanical anchor setting system comprises a mandrel longitudinally moveable through a sleeve, a slip system operatively connected to the sleeve and the mandrel (for gripping the casing or formation when the slips are engaged) and a setting control system operatively connected to the sleeve and the mandrel.

BRIEF DESCRIPTION OF THE DRAWINGS

The invention is described with reference to the following drawings in which.

DETAILED DESCRIPTION OF THE INVENTION

System Overview

Figure 1:
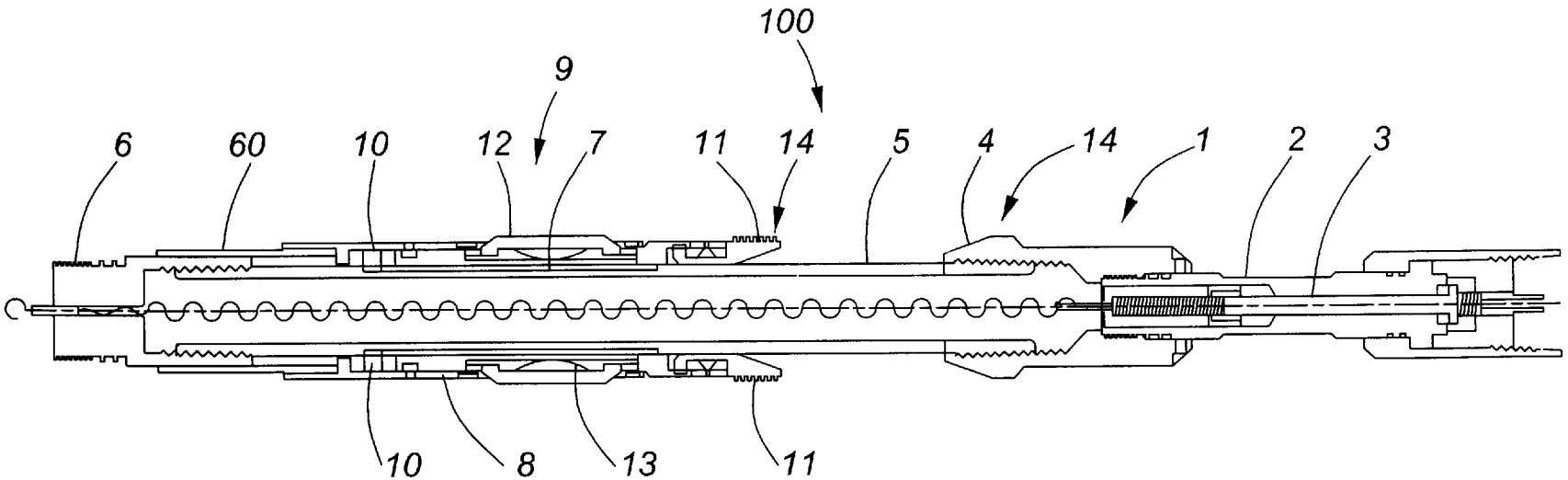
FIG. 1 is a perspective, partial cross-sectional view of the overall assembly in the disengaged position.
Figure 2:
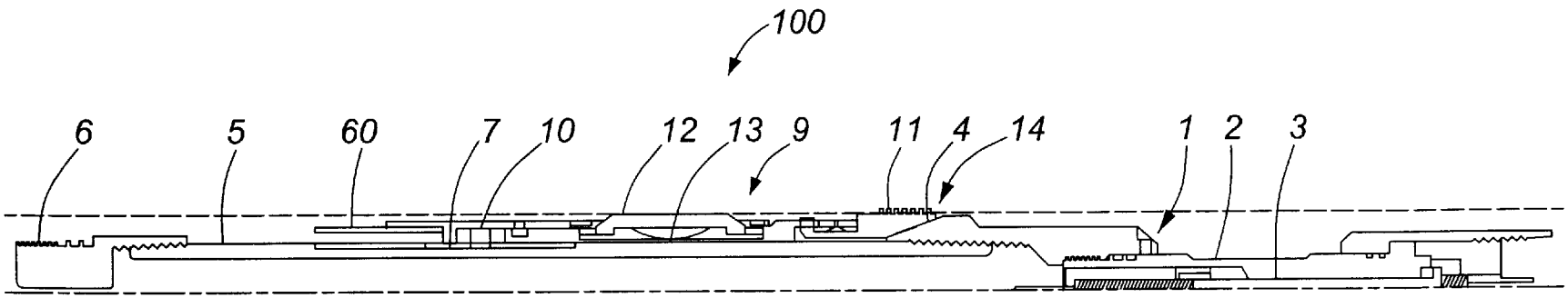
FIG. 2 is a perspective, partial cross-sectional view of one-half of the overall assembly in the engaged position.

A downhole mechanical anchor and perforating gun system 100 is shown in FIGS. 1 and 2. The system 100 includes a perforating gun assembly 1, a mandrel 5, a sleeve 8, a slip control system 14 and a setting control system 15. In accordance with the invention and with reference to the Figures, an improved mechanical anchor setting system is described in the context of its use.

The system 100 is assembled on the surface and is then lowered or pushed downhole using either wireline, coil tubing or other pipe as is known in placing downhole tools. Prior to lowering, the setting control system is set in a disengaged position allowing downhole movement of the system 100. Once the system 100 is at the appropriate depth or position, uphole tension is applied to the wireline or tubing which moves the perforating gun system 1, which is connected to the mandrel 5, upward. The sleeve 8 remains stationary by the frictional engagement of the drag/centering system 9 with the casing or formation while the mandrel 5 is pulled uphole. The movement of the mandrel 5 through the stationary sleeve 8 forces the slip control system 14 to engage with the casing or formation and sets the setting control system 15 in the engaged and locked position wherein the slip control system prevents uphole movement of the system 100 while upward tension is applied. Thereafter, when the perforating gun 2 is discharged, any upward surge forces from the perforating gun continually force the slips 11 of the slip control system 14 outward from the sleeve 8 to grip against the casing or formation.

In order to disengage the system 100, upward tension is released and the mandrel 5 is allowed to move downward until the setting control system (FIGS. 3 and 4) is in the disengaged position. If desired, the system 100 can be moved uphole by applying uphole tension to the top collar 6 causing the setting control system 15 to enter an intermediate position which prevents the slip control system 14 from engaging with the casing or formation and which allows uphole movement. The overall system can then be moved uphole to a new zone by pulling the system 100 uphole. That is, once the overall assembly is in the desired position in the well bore, the slip control system 14 can again be set by releasing wireline tension or applying downhole force to allow the setting control system 15 to be set in the disengaged position and then reapplying uphole tension to the system 100 to move the setting control system 15 into an engaged position.

In order to retrieve the overall assembly from the well bore, the setting control system 15 is placed into the disengaged position and tension is then applied to move the setting control system 15 into an intermediate position allowing the system 100 to be moved uphole and out of the well bore without engaging the slip control system 14. The system may also include a fishing sleeve 60 to assist in retrieval of the system in the event the tool becomes jammed downhole.

A more detailed description of each of the sub-systems follows:

Mandrel 5

The end of the mandrel 5 positioned downhole is attached to the perforating gun system 1 and the other end of the mandrel 5 positioned uphole is attached to a collar locator connector 6. The mandrel 5 can be placed anywhere in the string as determined by the particular operation. The mandrel 5 slides longitudinally within the sleeve 8.

Figure 3:
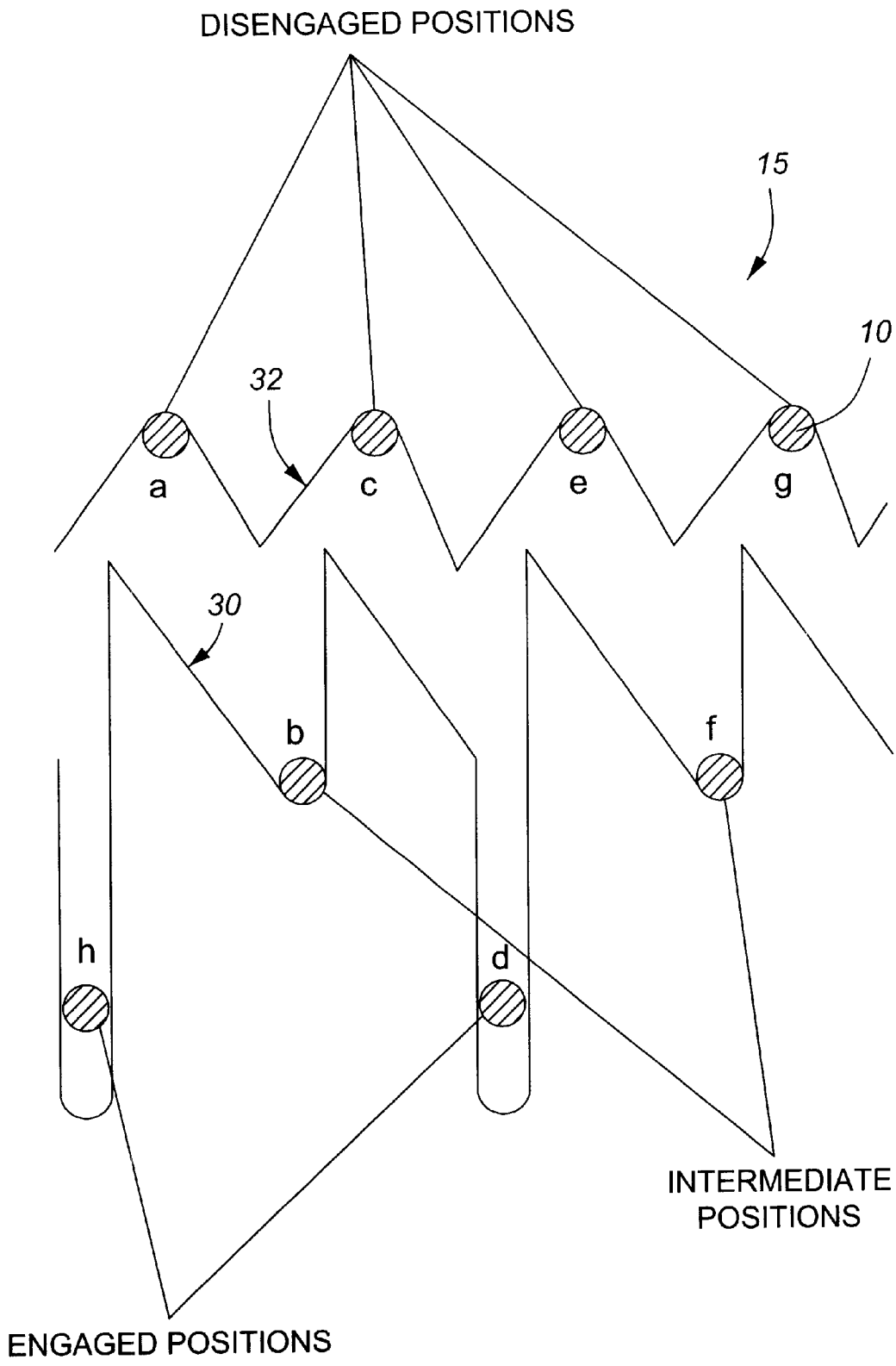
FIG. 3 is a schematic diagram of a first embodiment of a slot control system.
Figure 4:
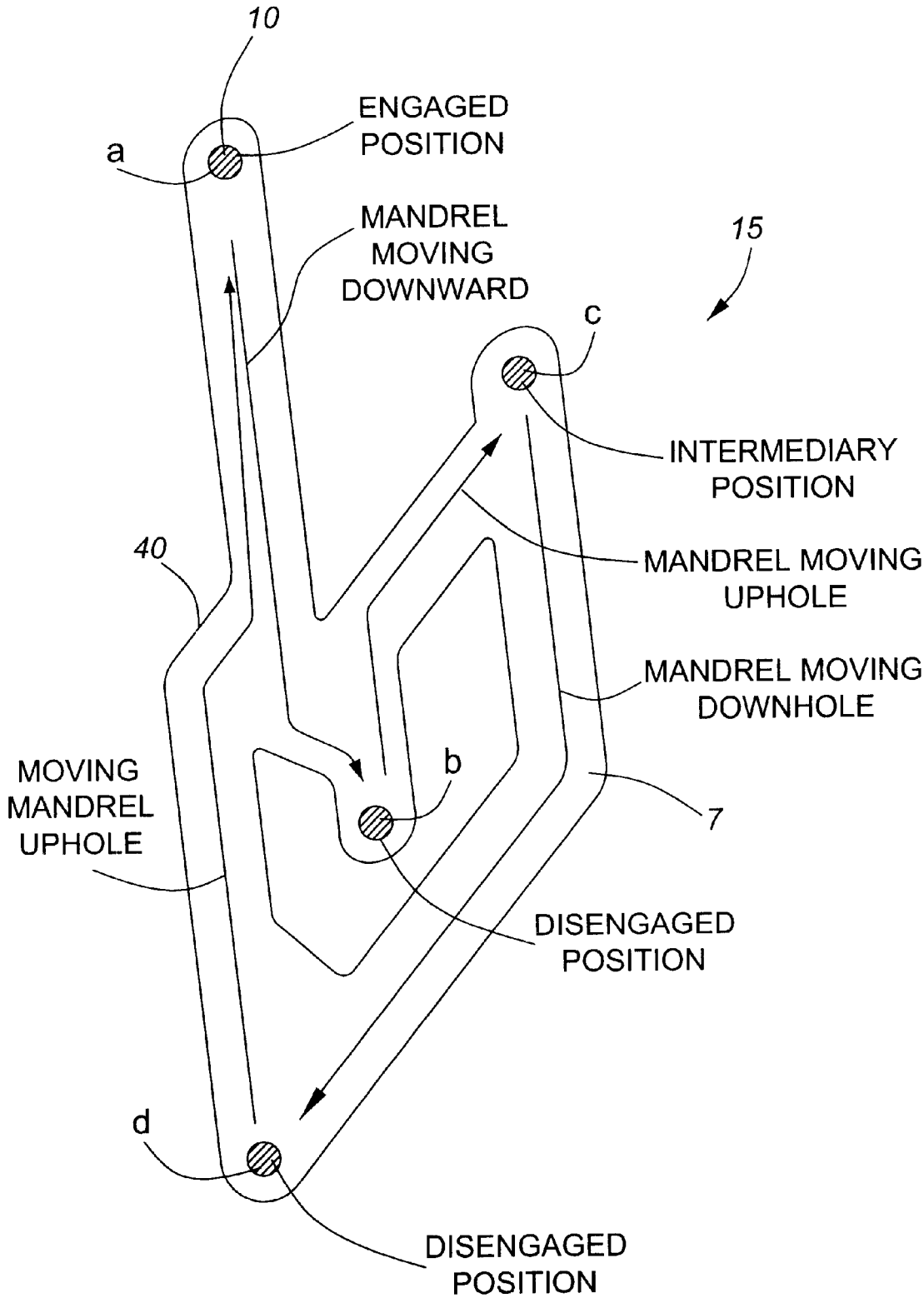
FIG. 4 is a schematic diagram of a second embodiment of a slot control system.

In one embodiment, the mandrel 5 consists of at least an elongated cylinder and a slot control system 7. FIG. 3 shows a first embodiment of the slot control system 7 and FIG. 4 shows a second embodiment. With reference to FIG. 3, the setting control system includes a pin 10 on the sleeve 8 and a slot control system 7 on the mandrel 5, shown schematically in FIG. 3. The slot control system 7 includes a slot having a number of set positions in the mandrel 5 such that the slots are oriented longitudinally in an uphole and downhole arrangement. The sleeve rotationally moves through the slot control system 7 between the various positions a–h shown in FIG. 3. Positions g, e, c and a as indicated in FIG. 3 are located uphole from positions f, d, b and h.

In FIG. 3, positions g, e, c and a represent disengaged positions where the slips 11 are not set. Positions d and h in FIG. 3 are the engaged positions and positions b and f are the intermediate positions.

When the system 100 is moved downhole, the pin 10 starts in positions g, e, c, or a in the slot control system 7. Once the system 100 is at its desired position in the well bore then the mandrel 5 is moved uphole which moves the slot control system 7 about the pin 10 until the pin 10 is located in position f, d, h or h, depending on whether the pin started in position g, e, c or a, respectively. The sleeve's path around the mandrel 5 is guided by the geometry of the slot and the inclined surfaces between each set position. For example, if the pin starts in position a, when the mandrel 5 is moved uphole the sleeve remains stationary relative to the well bore and the pin contacts inclined surface 30 causing a rotation of the sleeve relative to the mandrel such that the pin moves to position b. Similarly, if the pin's starting position is b, as the mandrel is moved downhole the sleeve remains stationary relative to the well bore and the pin contacts inclined surface 32 causing a rotation of the sleeve relative to the mandrel such that the pin moves to position c. Similarly, the pin can move through positions c to h through successive uphole/downhole movement of the mandrel.

Further guidance for the slot control system 7 is provided by offsetting opposing slots horizontally. This ensures that the inclined surface (FIG. 3) opposing each slot covers a horizontal range which forces the slot control system 7 to contact the pin 10 on the slot's opposing inclined surface whose slope will force the slot control system 7 to move along the pin 10 into the desired slot setting.

In a second embodiment of the slot control system 7 represented in FIG. 4, the slot control system 7 moves about the pin between the positions a–d in a similar manner as described above for the embodiment represented in FIG. 3. In FIG. 4, the engaged position is represented by position a, the disengaged positions are b and d and the intermediate position is at c. The slot control system 7 in FIG. 4 makes similar use of the slot's geometry and the inclined surfaces between each set position to guide the slot control system 7 through each position. Whereas the slot control system 7 in FIG. 3 forms a continuous horizontal slot around the mandrel 5, the slot control system 7 in FIG. 4 forms a closed-loop slot. Once the pin is at position d in FIG. 4, the slot control system 7 is guided back to the starting position a by the slope of the inclined surface 40 downhole from position d.

In an alternate embodiment of the mandrel 5, the pin 10 may be located on the mandrel 5 and the slot control system 7 embodied in FIG. 3 or FIG. 4 located on the sleeve 8 in which case the pin 10, located on the mandrel 8, would move within the slot control system 7 located on the sleeve 8. In this embodiment the orientation of the slot control system 7 would be reversed such that positions g, e, c and a would be oriented downhole from positions f, d, b or h in FIG. 3 and positions a and c would be positioned uphole from positions b and d in FIG. 4.

In a further alternate embodiment of the mandrel 5, applicable only to the slot control system 7 embodied in FIG. 3, there may be two pins 10 located horizontally equidistantly around the sleeve which would operate the slot control system's 7 position to guide the mandrel's movement between each position. Alternately, the two pins 10 may be located horizontally equidistantly on the mandrel 5 which would move within the slot control system 7 to guide the mandrel's 5 movement between the variable positions. If the pins are located on the mandrel 5, the orientation of the slot control system 7 must be such that positions a and c in FIG. 3 are positioned uphole from positions b and d in FIG. 3.

Sleeve 8 and Drag/Centering System 9

The sleeve 8 is preferably an elongated cylinder having a drag/centering system 9, slips 11 and two pins 10 equidistantly spaced around the sleeve 8 to engage the slot control system 7.

The drag/centering system 9 ensures that the sleeve 8 remains stationary at its desired position in the well bore while the mandrel 5 is moved longitudinally through the sleeve 8. The drag/centering system 9 frictionally engages the casing or formation through means of outwardly spring biased drag blocks 12.

In an alternate embodiment, the drag/centering system 9 includes at least two drag block assemblies for centering the system 100 and maintaining frictional engagement with the casing or formation. In one embodiment, the system includes four drag block assemblies including a drag spring 13 and a drag block 12 spaced equidistantly around the sleeve 8. In alternate embodiments, the drag/centering system 9 consists of more than two drag block assemblies spaced equidistantly around the sleeve 8 and may use other means to frictionally engage the casing or formation.

In an alternative embodiment, the sleeve 8 includes a drag/centering system 9, slips 11 and a slot control system 7 in the sleeve 8 for engaging a pin or pins 10 on the mandrel 5.

Slip Control System 14

The slip control system 14 includes setting slips 11 located on the sleeve 8 and a sleeve coupling 4 connecting the perforating gun system 1 to the mandrel 5.

Each setting slip 11 is wedged-shape where its inner surface is inwardly tapered and has a serrated outer edge designed to engage the casing or formation. The shape of the setting slips 11 compliments a sleeve coupling 4, which connects the mandrel 5 to the perforating gun system 1. The sleeve coupling 4 has an outwardly tapering surface that inclines outward from the mandrel 5 forming a frustoconical or cone shape. The cone forms a wedge which slides underneath the outwardly tapering surfaces of the slips 11 located on the sleeve 8 when the setting control system 15 is in an engaged position (positions d and h in FIG. 3 and position a in FIG. 4). When the perforating gun is detonated or oil and gas surge upward, the cone continues to force the slips 11 outward into the casing or formation. Once the mandrel 5 is moved into any position where the setting control system 15 is not engaged, the slips 11 return to their regular position where they do not engage the casing or formation.

In one embodiment the slip control system 14 consists of at least two setting slips 11 located equidistantly around the sleeve 8 and positioned further downhole on the sleeve 8 from the drag/centering system 9. In a still further embodiment, more than two setting slips could be located around the sleeve 8 at various intervals. In a still further embodiment, two or more setting slips 11 could be located on the sleeve coupling 4 and the inclined outer surface forming the cone could be located on the sleeve 8.

The embodiments of the present invention described above are meant to be illustrative of the preferred embodiments of the present invention and are not intended to limited the scope of the present invention. Various modifications which would be readily apparent to one skilled in the art are intended to be within the scope of the present invention. The only limitations to the scope of the present invention are set out in the claims that follow.

What is claimed is:

1. A mechanical anchor setting system for anchoring a downhole assembly within a casing or formation of a well bore, the system comprising:

a mandrel longitudinally moveable within a sleeve;

a slip system operatively connected to the sleeve and the mandrel for gripping the casing or formation when in an engaged position; and a setting control system operatively connected to the sleeve and the mandrel for selectively setting the slip system in any one of the engaged position, a disengaged position allowing downhole movement of the system and an intermediate position allowing uphole movement of the system without engaging the slip system.

2. The system of claim 1 wherein the setting control system includes a pin and slot system having a plurality of set positions for setting the system in any one of the engaged position, the disengaged position or the intermediate position.

3. The system of claim 2 wherein the sleeve includes the slot system and the mandrel includes the pin.

4. The system of claim 2 wherein the mandrel includes the slot system and the sleeve contains the pin.

5. The system of claim 1 wherein the setting control system includes two pins and two corresponding slot systems each having a plurality of set positions for setting the system in any one of the engaged position, a disengaged position or an intermediate position.

6. The system of claim 5 wherein the sleeve includes each slot system and the mandrel includes the pins.

7. The system of claim 5 wherein the mandrel includes each slot system and the sleeve includes the pins.

8. A mechanical anchor setting system for anchoring a downhole assembly against a downhole casing or formation in a well bore, the setting system comprising a mandrel longitudinally moveable within a sleeve, the mandrel including a slot system in operative communication with a pin on the sleeve for selective actuation of a slip system operatively connected to the sleeve and the mandrel for gripping the casing or formation, the slot system and pin operable between an engaged, a disengaged and an intermediate positions by successively moving the mandrel uphole and downhole, the engaged position for engaging the slip system, the disengaged position for moving the setting system downhole and an intermediate position for moving the setting system uphole without engaging the slip system.

9. A method of setting a mechanical anchor setting system as defined in claim 1 comprising the steps of:

(a) inserting the mechanical anchor setting system in a well bore; and, (b) selectively moving the mandrel uphole or downhole to positively set the setting control system in any one of an engaged position, a disengaged position and an intermediate positions.

* * * * *